US005084806A

United States Patent [19]

Nagai

[11] Patent Number: 5,084,806

[45] Date of Patent: Jan. 28, 1992

[54] LIGHT EMITTING DISPLAY DEVICE AND STEM FOR LIGHT EMITTING DISPLAY DEVICE

[76] Inventor: Kiyoshi Nagai, 228-91, Sachigawa, Oomiya-shi, Saitama, Japan

[21] Appl. No.: 599,630

[22] Filed: Oct. 18, 1990

[30] Foreign Application Priority Data

Oct. 19, 1989 [JP] Japan ..... 1-272376

[51] Int. Cl.[5] ..... F21V 1/00

[52] U.S. Cl. ..... 362/214; 362/240; 313/272

[58] Field of Search ..... 362/211, 214, 215, 240, 362/249; 313/272, 435, 634

[56] References Cited

U.S. PATENT DOCUMENTS 2,343,754 3/1944 Donley ..... 362/215
3,604,971 9/1971 Tracy ..... 313/272
3,780,326 12/1973 Raago ..... 313/272

FOREIGN PATENT DOCUMENTS 77451 7/1933 Denmark ..... 362/211
980142 1/1965 United Kingdom ..... 313/272

*Primary Examiner*—Ira S. Lazarus
*Assistant Examiner*—Richard R. Cole
*Attorney, Agent, or Firm*—McAulay Fisher Nissen Goldberg & Kiel

[57] ABSTRACT

Disclosed is a light emitting display device comprising: a stem member comprising a lidless container having a plural number of chambers divided by partially chipped walls, filaments and their support posts arranged in each chamber; and a lid panel having transparent windows and light-shielding face. The lid panel is airtightly fixed on the upper side of the container so that the light-shielding face covers the upper portions of the chipped parts of the walls. The inside of the device is made vacuum.

2 Claims, 3 Drawing Sheets

LIGHT EMITTING DISPLAY DEVICE AND STEM FOR LIGHT EMITTING DISPLAY DEVICE

BACKGROUND OF THE INVENTION

1. Field of the Invention

The present invention relates to a light emitting display device and a stem advantageously used for the preparation of the light emitting display device. Particularly, the invention relates to a light emitting display device (which is also called "display lamp" or "display") having high luminance and high distinguishability, and a stem advantageously used for the preparation of the light emitting display device.

2. Description of Prior Art

Light emitting display devices to indicate various signals, symbols and numerical values, which have been used for various displays such as an instrument panel of airplane, need to have high luminance and high distinguishability. A conventional device comprises a combination of a plural number of fine bar filaments or small lamps. Examples of such light emitting display devices using a combination of a plural number of fine bar filaments or small lamps are shown in FIG. 1 and FIG. 2.

As is shown in FIG. 1, in the light emitting display device using bar filaments, a plural number of pairs of electrically conductive posts 12 are provided on a base plate (or container) 11 and a filament 13 is strung between each pair of posts. Usually, the surface of a light emitting display device is covered with a transparent lid panel and the condition surrounding a filament is made vacuum in order to protect the filament. Although the light emitting display device using bar filaments has simple constitution and exhibits uniform luminance, there is a case that the display is not easily recognizable, since the light emitting face of the filament is very narrow.

On the other hand, as is shown in FIG. 2, in the light emitting display device using small lamps, slender small lamps 23 are provided on a base plate (or container) 21. The light emitting face of the light emitting display device of this type is almost a rectangle and is so large that the display indicated by the device is easily recognizable. However, the device of this type has a defect that luminance of each light emitting face is apt to be not uniform, since the degree of vacuum in each small lamp employed varies from each other.

In order to solve the above-mentioned problems, the present applicant invented a light emitting display device comprising a container having a plural number of chambers, wherein a filament is arranged in each chamber so that an opening of each chamber can constitute one component of light emitting face; and already applied for patent (Japanese Patent Provisional Publication No. 62(1987) 113355). As is shown in FIG. 3, FIG. 3A and FIG. 3B, the device comprises a container 33 having chambers 32 which are defined by a plural number of walls 31. A filament 34 is arranged in each chamber 32, and the container 33 is covered with a transparent lid panel 35. In order to unify the degree of vacuum in each chamber, ditch 36 is provided on the base portion 33*a* of the container 38 and thin pipe 38 is provided in the ditch 36. The thin pipe 38 has apertures 37 in every constant distance so that each chamber can have the aperture, whereby gas can freely flow among the chambers through the pipe. By using the exhaust pipe 39 provided in a certain chamber, the inside of the container 33 can be made vacuum and the inside of every chamber can be made uniformly vacuum. Therefore, the luminance of each light emitting face can be kept uniform.

The above-described known light emitting display device is very useful, because its light emitting face can be made to give any shape and size (volume, length, width, etc.,) and the luminance of each light emitting face can be kept uniform. However, the production cost of the display device is considerably high, because the process for the preparation of the device is complicated.

In more detail, the process for preparing the light emitting display device shown in FIG. 3 comprises; a step of burying thin pipe 38 having a plural number of apertures 37 into the ditch 36 which has been beforehand provided on the base 33*a*, a step of preparing a stem by fixing a frame body onto the base 33*a* to form the side wall of the container 33 and walls 31, a step of arranging filaments to prepare a stem member, a step of providing a transparent lid panel onto the stem member and a step of exhausting air to make the inside of the container vacuum.

SUMMARY OF THE INVENTION

There are provided by the present invention a light emitting display device whose light emitting face can be made to give any shape and size, and in which the luminance of each light emitting face can be kept uniform; and a stem advantageously used for the preparation of the light emitting display device.

There are provided by the invention a light emitting display device which has the above-mentioned features and simple constitution, and which can be easily prepared; and a stem used for the preparation of the light emitting display device.

The invention resides in a light emitting display device of which inside is made vacuum and which comprises:

a stem member comprising a container having an open upper face and a plural number of chambers divided by partially chipped walls, filaments and their support posts arranged in each chamber; and a lid panel which has transparent windows and light-shielding face and which is airtightly fixed on the open upper face of the container so that said light-shielding face covers the upper portions of the chipped parts of the walls.

The above-described light emitting display device can be easily and reliably prepared by using a stem for a light emitting display device comprising:

a lidless container having an exhaust hole provided on its base portion or side wall portion, and a plural number of chambers divided each other by partially chipped walls; and at least two support posts for filaments provided in each chamber.

DETAILED DESCRIPTION OF THE INVENTION

Figure 1:
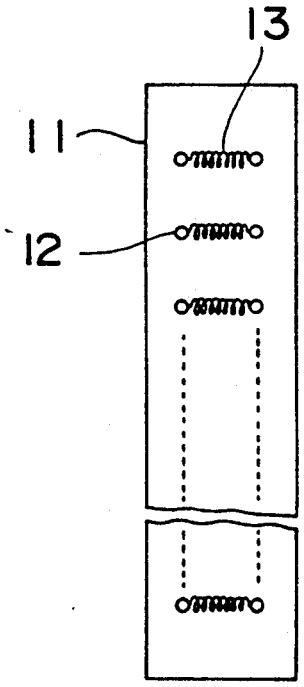
FIG. 1 (PRIOR ART)
FIG. 1 shows a conventional light emitting display device using a combination of bar filaments.
Figure 2:
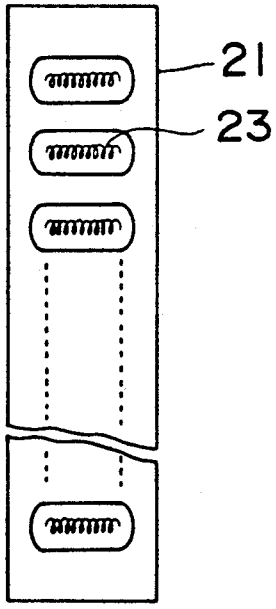
FIG. 2 (PRIOR ART)
FIG. 2 shows a conventional light emitting display device of other type using a combination of small lamps.
Figure 3:
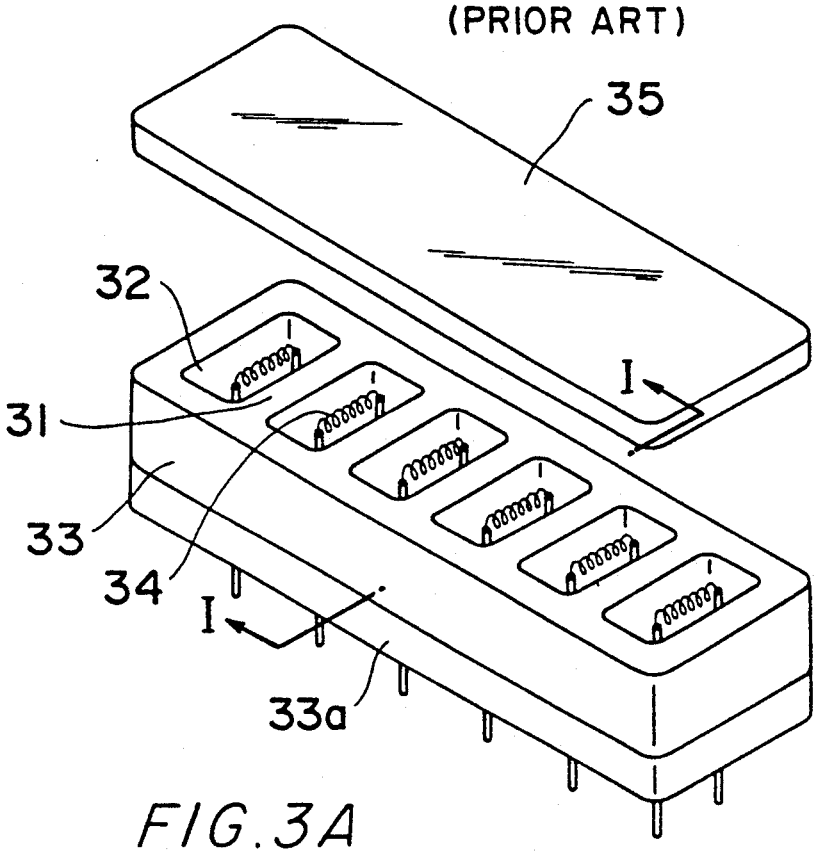
FIG. 3 (PRIOR ART)
FIG. 3 is a perspective view of a known light emitting display device of other type comprising a stem member and a lid panel.
Figure 3A:
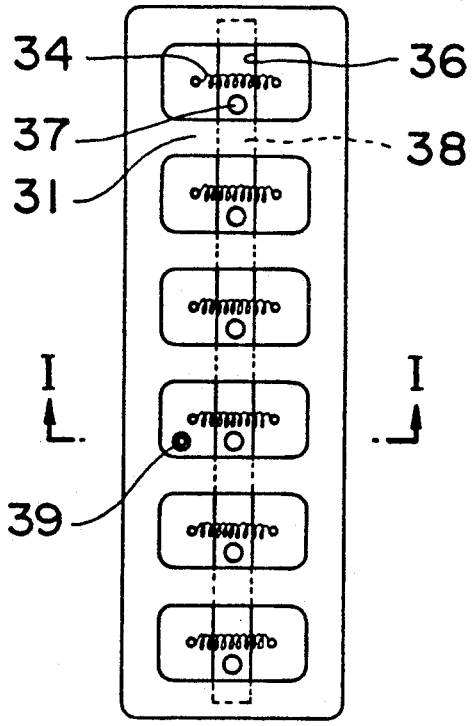
FIG. 3A (PRIOR ART)
FIG. 3A is a plan view of the stem member of the light emitting display device shown in FIG. 3.
Figure 3B:
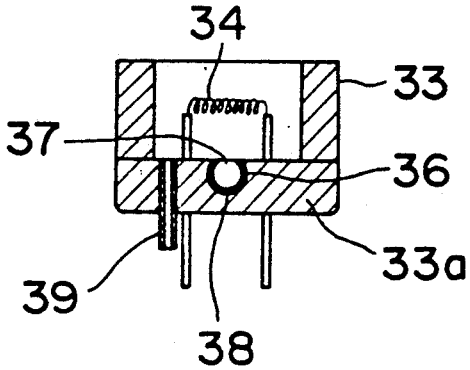
FIG. 3B (PRIOR ART)
FIG. 3B is a cross sectional view of the stem member of the light emitting display device taken on the line I—I shown in FIG. 3 and FIG. 3A.
Figure 4:
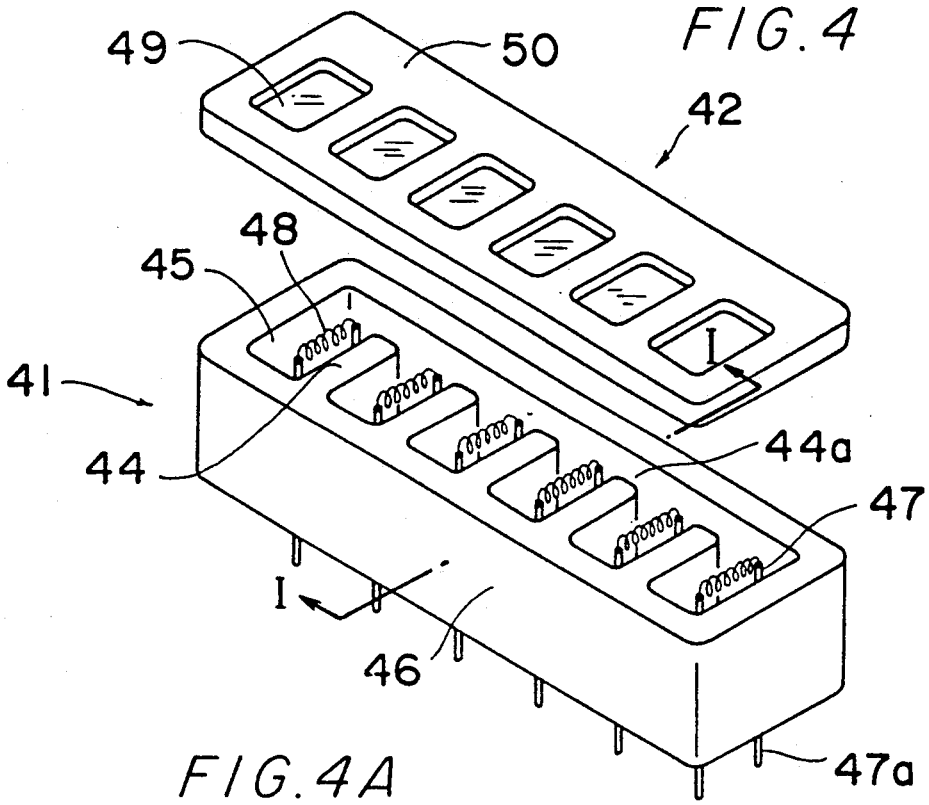
FIG. 4 is a perspective view of an example of a light emitting display device of the invention comprising a stem member and a lid panel.
Figure 4A:
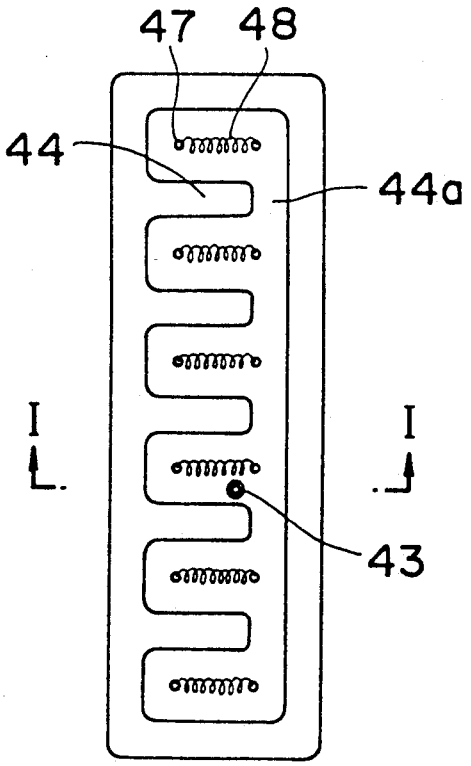
FIG. 4A is a plan view of the stem member of the light emitting display device shown in FIG. 4.
Figure 4B:
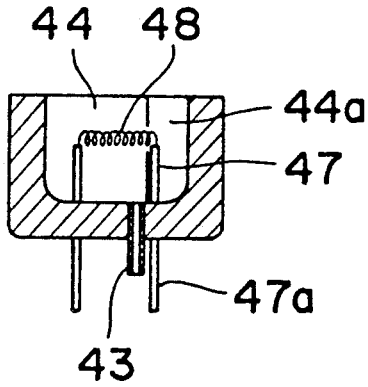
FIG. 4B is a cross sectional view of the stem member of the light emitting display device taken on the line I—I shown in FIG. 4 and FIG. 4A

FIG. 4 shows an example of a light emitting display device of the invention. In FIG. 4, the stem member and the lid panel are separately shown. FIG. 4A and FIG. 4B show a plan view and a cross sectional view, respectively, of the light emitting display device shown in FIG. 4. Namely, the light emitting display device of the invention consists of a stem member 41 and a lid panel 42.

The stem member 41 is prepared by providing filaments 48 onto each set of support posts 47 of a stem for a light emitting display device. The stem comprises: a lidless container 46 having an exhaust pipe (or exhaust hole, which is used for making the inside vacuum) 43 provided on the base portion(or the side wall portion) and a plural number of chambers 45 divided by walls 44 (which has a chipped part **44*a* for gas to flow freely throughout the chambers); and at least two support posts 47** for filaments provided in each chamber.

The container and the walls of the stem do not transmit light, and they can be integrally formed from glass materials containing metal or light-shielding powder, ceramic materials, resin materials containing metal or light-shielding powder. The container and the partially chipped walls can be integrally formed by casting metal, etching or laser processing. Further, they also can be integrally formed by molding of ceramics materials which do not transmit light, glass materials or resin materials containing light-shielding substance. A sheet (film or membrane) which does not transmit light may be provided on the inside surface of the container and on the surface of the walls in order that the container and the walls do not transmit light.

The chipped part of the wall is essential for gas to flow freely throughout the chambers. Therefore, the atmospheric pressure (i.e., the degree of vacuum) of each chamber can be unified by exhausting air through the chipped part from the exhaust hole provided on any one chamber. There is no specific limitation with respect to the position of the chipped part. However, the chipped part is preferably located on the corner of the wall, since the upper portion of the chipped part needs to be shielded from light so that light emitted from a filament in a chamber will not come through the chipped part of the wall into the next chamber. There are no specific limitations with respect to the size and the shape of the chipped part. The size and the shape of the chipped part can be desirably determined, depending upon the flow efficiency of gas and the degree of light shielding.

The base portion of each chamber is preferably formed as the shape of the longitudinal cross section and/or transverse cross section is a portion of a circle (an arc) or a portion of an ellipse, since such base can effectively reflect the light emitting from the filament to the upper side opening.

Support posts 47 for filaments are provided on the base (or the side) of the container. At least one pair of (i.e., two) support posts 47 are provided in each chamber. Three or more posts may be provided, if necessary. Each of the posts 47 has a terminal **47*a*** on the outside of the container for electric power supply.

Exhaust pipe 43 provided in the stem member 41 is used for making the inside of the container vacuum in the process for preparing the light emitting display process. The exhaust pipe 43 can be formed, for example, by connecting a very thin pipe onto a hole provided on the base portion of the container. The exhaust pipe is choked immediately after the inside of the container is made vacuum.

Lid panel 42 is fixed on the top of the stem member in which filaments has been provided. The stem member 41 and the lid panel are closely combined in order to keep the connecting portion sufficiently airtight.

Lid panel 42 of the light emitting display device of the invention has transparent windows 49 and light-shielding face. The transparent windows are provided for taking out light of the display, and the light-shielding face is provided in order to prevent light coming through the chipped part from transmitting to the outside. Therefore, the light-shielding face 50 of the lid panel is placed so as to cover the upper portion of the chipped part **44*a*** of each wall.

After the lid panel 42 is fixed on the stem member 41, the inside of the obtained fixed body is made vacuum by using the exhaust hole (exhaust pipe) 43. In this step, the chipped part of the wall enables every chambers to have the same degree of vacuum. After the degree of vacuum in the fixed body reaches the desired value, the exhaust pipe is choked by cold pressure welding or melting such as electric resistance welding to prepare the desired light emitting display device.

The light emitting display device of the invention has characteristic features in that its light emitting face can be made any shape and size, and that the luminance of each light emitting face can be kept uniform. Moreover, the device of the invention has simple constitution and can be easily prepared. Therefore, the light emitting display device of the invention is very useful. The stem of the invention is useful as an intermediate body in the process for preparing the light emitting display device of the invention. By using the stem, the light emitting display device of the invention can be advantageously produced.

What is claimed:

1. A light emitting display device which comprises:

a stem member comprising a container having an open face;

wall members within said container dividing said container into a plurality of separate chambers;

a filament and support post therefore in each chamber;

said wall members having opening therein to place the chambers in atmospheric communication with one another;

a lid panel having transparent windows and a light shielding face air tightly fixed on the open face of the container, said light shielding face cooperating with said openings in said walls to minimize the entrance of light from 1 chamber to another chamber.

2. The light emitting display device of claim 1 wherein said container has a single closable exhaust vent within one chamber.

* * * * *